US007404353B2

(12) United States Patent
Kriegsmann

(10) Patent No.: US 7,404,353 B2
(45) Date of Patent: Jul. 29, 2008

(54) PNEUMATIC CYLINDER FOR PRECISION SERVO TYPE APPLICATIONS

(75) Inventor: Michael K. Kriegsmann, Glen Ellyn, IL (US)

(73) Assignee: Sunstream Scientific, Inc., Chicago, IL (US)

( * ) Notice: Subject to any disclaimer, the term of this patent is extended or adjusted under 35 U.S.C. 154(b) by 553 days.

(21) Appl. No.: 11/078,863

(22) Filed: Mar. 10, 2005

(65) Prior Publication Data

US 2005/0229776 A1 Oct. 20, 2005

Related U.S. Application Data

(60) Provisional application No. 60/551,379, filed on Mar. 10, 2004.

(51) Int. Cl.
*F01B 31/00* (2006.01)

(52) U.S. Cl. ..... 92/163; 92/169.1

(58) Field of Classification Search ..... 92/5 R, 92/163; 181/256, 258
See application file for complete search history.

(56) References Cited

U.S. PATENT DOCUMENTS

| | | | | |
|---|---|---|---|---|
| 1,206,966 | A * | 12/1916 | Wilkins | 92/163 |
| 2,089,202 | A | 8/1937 | Gartin | |
| 2,146,213 | A | 2/1939 | Horton | |
| 2,147,150 | A | 2/1939 | Conklin et al. | |
| 2,761,425 | A * | 9/1956 | Bertsch et al. | 92/163 |
| 2,977,764 | A | 4/1961 | Matthews | |
| 3,783,590 | A * | 1/1974 | Allen | 181/230 |
| 3,820,446 | A | 6/1974 | Granbom et al. | |
| 4,406,215 | A | 9/1983 | Lacasse | |
| 4,735,047 | A | 4/1988 | Wiedmann | |
| 4,798,128 | A * | 1/1989 | Mita | 92/171.1 |
| 4,825,746 | A | 5/1989 | Herner | |
| 5,540,136 | A | 7/1996 | Noord | |
| 5,587,536 | A * | 12/1996 | Rasmussen | 91/1 |
| 6,044,752 | A * | 4/2000 | Harigaya | 92/163 |
| 6,186,484 | B1 | 2/2001 | Noda et al. | |
| 6,523,523 | B2 | 2/2003 | McCoy et al. | |
| 6,553,892 | B1 | 4/2003 | Kaneko | |
| 6,694,865 | B2 | 2/2004 | Kaneko et al. | |

FOREIGN PATENT DOCUMENTS

WO WO03106846 A1 * 12/2003

* cited by examiner

*Primary Examiner*—Michael Leslie
(74) *Attorney, Agent, or Firm*—Bell, Boyd & Lloyd LLP

(57) ABSTRACT

A pneumatic cylinder designed to convert compressed air into mechanical output is disclosed. The pneumatic cylinder includes a piston and rod assembly with supporting components coaxially disposed and arranged to achieve a linear mechanical force in accordance with a differential pressure across the piston. A cylindrical sleeve, secured to end caps on both openings, encircles the piston and rod assembly and helps guide the piston during travel. Additionally, a manifold, which serves as a conduit for airflow between each individual cylinder volume and an external air control device, is disposed such that the cylindrical sleeve and end caps are nested, in a concentric manner, within the manifold. This arrangement results in a dynamic relationship between airflow and differential pressure that is conducive to precision force and motion control.

38 Claims, 5 Drawing Sheets

PNEUMATIC CYLINDER FOR PRECISION SERVO TYPE APPLICATIONS

RELATED APPLICATIONS

This application claims the benefit of U.S. Provisional Application No. 60/551,379, filed Mar. 10, 2004 entitled "Pneumatic Cylinder for Precision Servo Type Applications" which is incorporated herein by reference.

FIELD

The present disclosure relates to pneumatic cylinders and, more particularly, to pneumatic cylinders with reduced acoustical vibration.

BACKGROUND

Conventional pneumatic cylinders provide a conduit for airflow into and out of the head and rod end volumes by means of ports machined into the respective head and rod end caps. Said ports serve as anchor points for plumbing that then communicates airflow to a control valve network. While such an arrangement has a certain level of operability, it typically creates a poor dynamic relationship between desired airflow and differential pressure. Consequently, attempts to apply such devices in precision applications have met with limited success.

SUMMARY

The pneumatic cylinder disclosed herein provides a unique way to communicate airflow between a control valve and the working volumes of the pneumatic cylinder. By nesting the fundamental components of a pneumatic cylinder (e.g., the head and rod end caps, the cylindrical piston sleeve, and the piston/rod assembly) within a manifold, conduits for airflow communication are created in channels formed by the outer diameter of the cylindrical piston sleeve and the internal geometries of the manifold. Furthermore, by mounting said control valve to said manifold, the length of the flow path from said valve to said working volumes will be minimized.

The geometry of the airflow channels is such that the cross-sectional area of the channels is approximately equal to the cross-sectional area of the piston sleeve. Furthermore, acoustical vibrations that are produced may be diffused using silencers. These arrangements optimize the dynamic relationship between desired airflow and differential pressure. As a result, the pneumatic cylinder disclosed herein is particularly suitable for applications requiring precision control of force and motion.

DETAILED DESCRIPTION OF EXEMPLARY EMBODIMENTS

Figure 1:
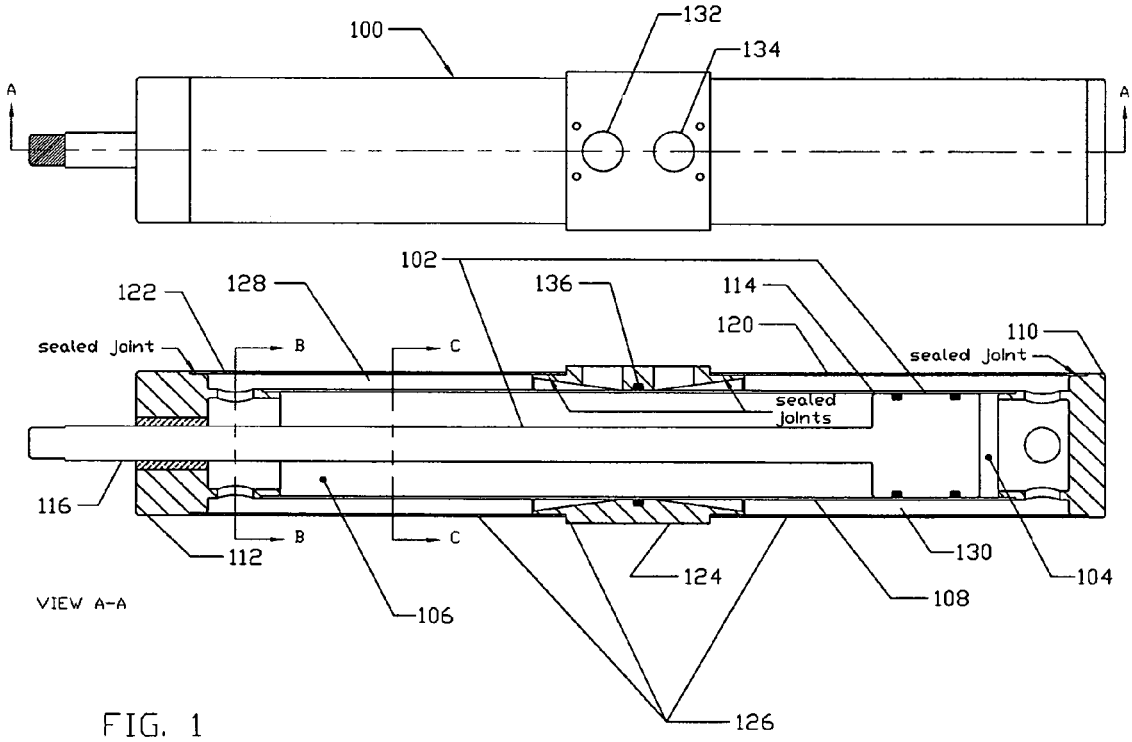
FIG. 1 illustrates a view of an example pneumatic cylinder that displays the cylinder head and rod end working ports and a cross section of the cylinder taken along lines A-A.

A pneumatic cylinder 100 designed to convert compressed air into mechanical output is illustrated in FIG. 1. Differential pressure across a piston/rod assembly 102 produces a force that can extend the piston/rod assembly 102, or cause the piston/rod assembly 102 to retract. The differential pressure is the difference in air pressure between the head end working volume 104 and the rod end working volume 106. The head end working volume 104 is the cylindrical chamber created by the piston/rod assembly 102, the piston sleeve 108, and the head end cap 110. The rod end working volume 106 is the cylindrical chamber created by the piston/rod assembly 102, the piston sleeve 108, and rod end cap 112. The piston sleeve 108 also serves to guide the piston 114 of the piston/rod assembly 102. It should be noted that the air pressure in each chamber is not uniform, and that variations over space for any specific point in time is to be expected. In addition, although cylindrical shapes are discussed in the exemplary embodiment herein, it will be readily recognized that any suitable shape(s) may be used.

Air pressure in each working volume 104 and 106 can be altered in any suitable manner. For example, the mass of air contained within a working volume 104 and/or 106 can be changed by allowing air to flow into or out of the working volume 104 and/or 106. During an extension of the rod 116, air flows into the head end working volume 104, thus increasing pressure in the head end working volume 104. Also during an extension of the rod, air flows out of the rod end working volume 106, thus decreasing pressure in the rod end working volume 106. Preferably, a pneumatic control valve 118 is used to control the communication of airflow into and out of the working volumes 104 and 106. The pneumatic control valve 118 is capable of directing compressed air into one of the working volumes 104 or 106, and conversely, discharging compressed air out of the other working volume 106 or 104 (e.g., to atmosphere).

A head end sleeve 120 and a rod end sleeve 122 are secured to a manifold coupler 124. For example, the head end sleeve 120 and the rod end sleeve 122 may each be a cylindrical tube that is secured to the manifold coupler 124 by brazing. However, any suitable process that produces an airtight seal to create a manifold 126 may be used. Preferably, the manifold 126 is assembled coaxially about the piston sleeve 108, such that the piston sleeve 108 is encircled by, or nested within, the manifold 126. The free end of the head end sleeve 120 is secured to the head end cap 110, and the free end of the rod end sleeve 122 is secured to the rod end cap 112. Any suitable method of securing the sleeves 120 and 122 to the caps 110 and 112 that produces an airtight seal may be used (e.g., brazing). Any suitable method of producing the manifold 126 and/or the sleeves 120 and 122 may be used (e.g., extrusion).

This arrangement creates a rod end channel 128 and a head end channel 130. The rod end channel 128 is an annular conduit for airflow between the rod end working volume 106 and a rod end port 132. The head end channel 130 is an annular conduit for airflow between the head end working volume 104 and a head end port 134. An O-ring 136, or other suitable seal, contained within an inner dimension groove on the manifold coupler 124, isolates the end channels 128 and 130 from each other. Damping film 138 preferably lines the cylindrical features that define the rod end channel 128 and the head end channel 130. Specifically, the outer diameter of the piston sleeve 108, the inner diameter of the rod end sleeve 122, and the inner diameter of the head end sleeve 120 may be lined with any suitable material that absorbs noises. The damping film 138 reduces noise emanated from the pneumatic cylinder 100 to the surrounding space.

Figure 2:
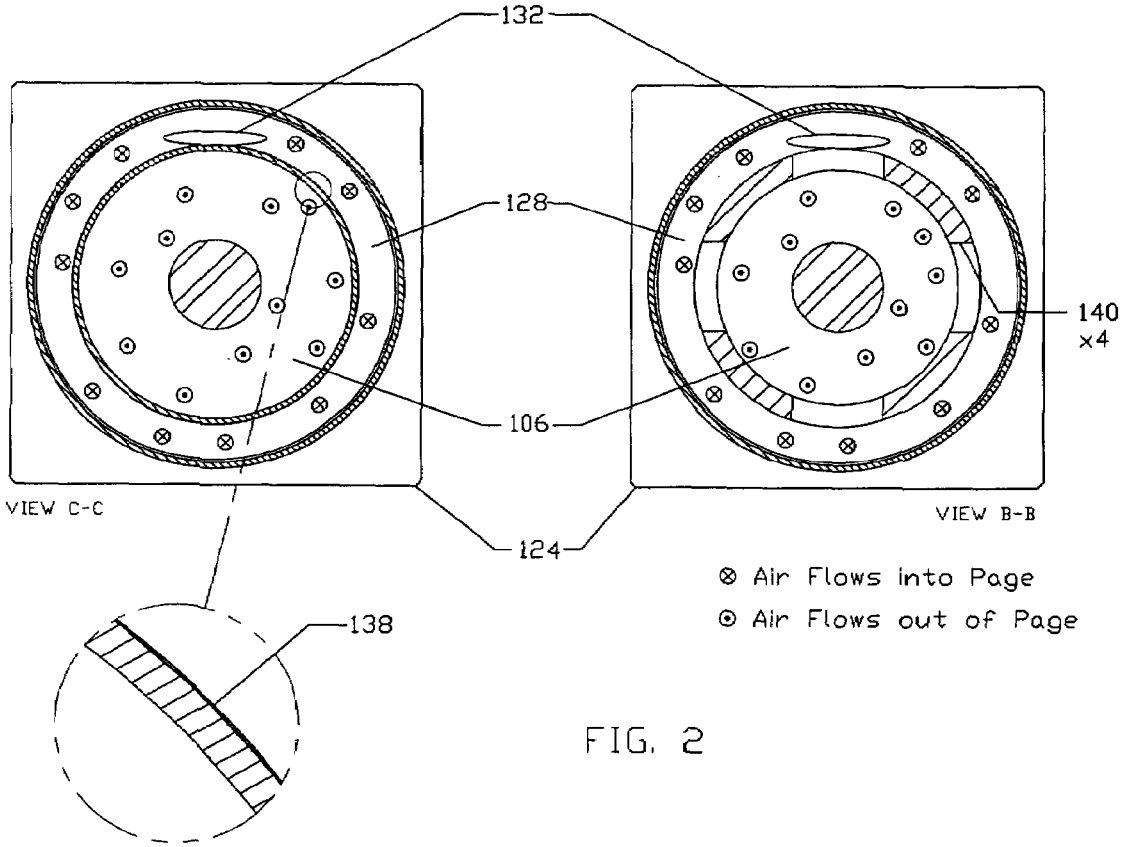
FIG. 2 illustrates a cross section of the example cylinder taken along lines B-B, a cross section of the example cylinder taken along lines and along lines C-C, and a blowup of view C-C illustrates a lining on the piston sleeve to silence noise.

Airflow is exchanged between the end channels 128 and 130 and the working volumes 106 and 104 by means of holes, slots, or like features machined into the respective head end cap 110 and/or rod end cap 112. Referring to FIG. 2, view B-B, the arrows show how air mass flows from the rod end working volume 106 into the rod end channel 128 by passing through four cross-drilled holes 140 in the rod end cap 112. From the rod end channel 128, airflow is exhausted out the rod end port 132. This particular illustration details the transmission of airflow during control valve action that attempts to decrease the air pressure in the rod end working volume 106, and increase the pressure in the head end working volume 104.

Figure 3:
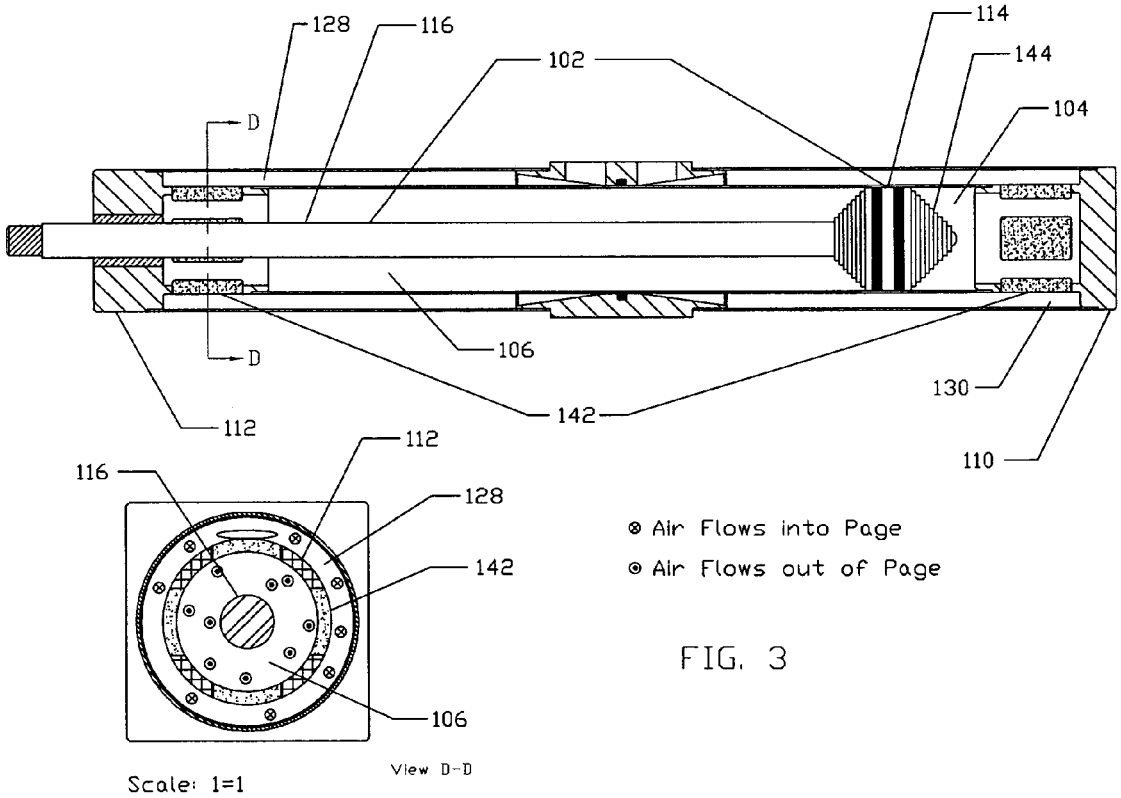
FIG. 3 illustrates the longitudinal cross section taken along lines A-A as shown in FIG. 1, but with silencing elements incorporated into the head and rod end caps, and with an alternate, un-cross sectioned, piston/rod assembly contained within the cylinder bore.
Figure 4:
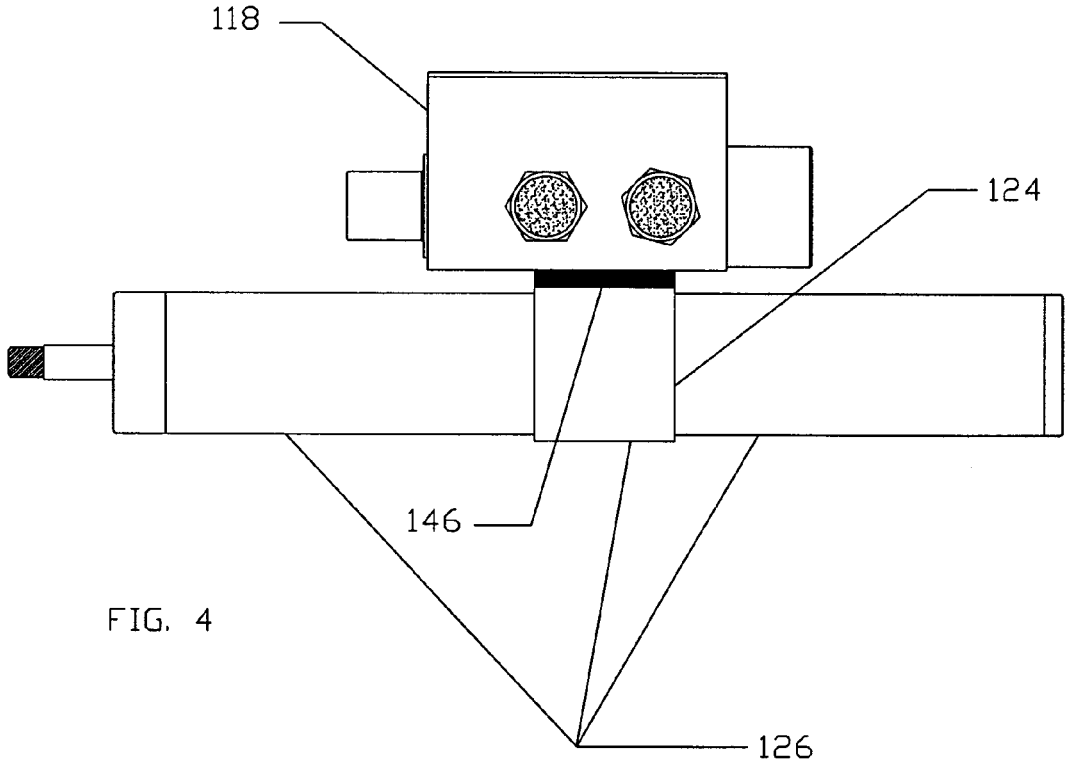
FIG. 4 illustrates the mounting of a control valve to the manifold coupler.
Figure 5:
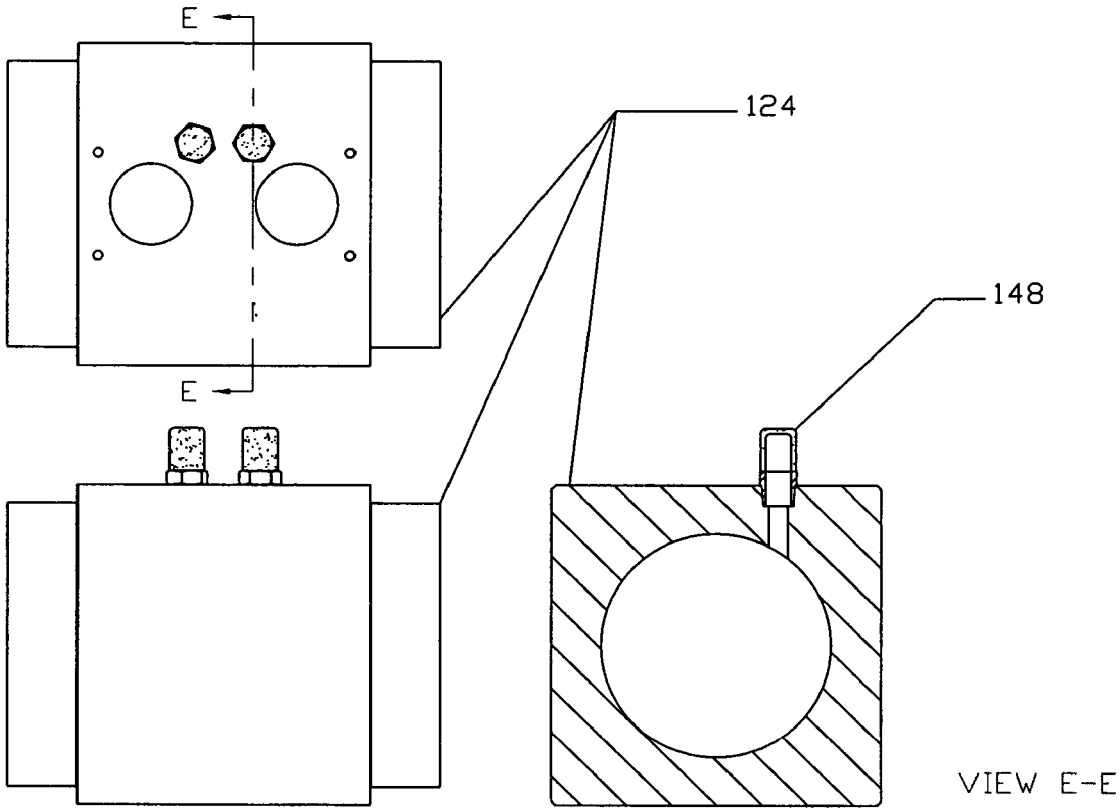
FIG. 5 illustrates the manifold coupler ported to provide the control valve with a silenced pressure signal from each working volume.

Silencers 142 may be included in the head end cap 110 and/or the rod end cap 112. The silencers 142 are preferably disposed in the direct path of airflow from the end channels 128 and 130 to their respective working volumes 106 and 104. Preferably, the silencers 142 function in lieu of the cross-drilled holes 140 as a path to communicate airflow between the channels 128 and 130 and the working volumes 106 and 104. The silencers 142 may be any suitable element that is placed in the path of a moving air column, which allows for the transmission of gas molecules, with minimal energy loss, while attenuating pressure or shock waves carried across the element. For example, a porous, sintered bronze element may be used as a silencer 142. A circumferential array of silencers 142, integral to the end caps 110 and 112, is illustrated in FIG. 3. This configuration attenuates the transmission of shock waves between each channel 128 and 130 and the corresponding working volumes 106 and 104. Referring to view D-D, the arrows show how air mass flows from the rod end working volume 106 into the rod end channel 128 by passing through four silencers 142 in the rod end cap 112.

An alternate embodiment of the piston/rod assembly 102 is illustrated in FIG. 3. In this embodiment, the piston 114 is preferably machined from cylindrical stock into a plurality of concentric discs 144. The diameter of each disc gets progressively smaller as the series extends from each side of the center of the piston 114. Preferably, each face of each disc 144 is perpendicular to the centerline of the rod 116. Hence, the working area, upon which differential pressure acts to create a force on the piston/rod assembly 102, is dispersed among a plurality of planes. This geometry creates a diffuser that restricts some shock waves from containment in a minimal frequency spectrum.

The manifold coupler 124 also acts as a structure to which the control valve 118 may be secured. When mounted directly to the manifold 126 (as opposed to a connection via soft or hard plumbing), the control valve 118 can communicate airflow with the channels 128 and 130, via the ports 132 and 134. In addition, the manifold coupler 124 can be ported to communicate the air pressure in each channel 128 and 130, through silencers 142 to cavities featured within the body of the control valve 118. The cavities are preferably sealed against the upper surface of the manifold coupler 124 when the control valve 118 is mounted to the manifold coupler 124. Pressure sensors, assimilated within each cavity, may be used to convert the silenced pressure signal into an electric signal suitable for acquisition by an analog to digital converter or like electronic measurement device.

In addition, an absorptive element 146 may be coupled between the control valve 118 and the manifold 126 to reduce mechanical vibrations transmitted between the control valve 118 and the manifold 126. For example, the absorptive element 146 may be constructed of polyurethane or other suitable material. Preferably, the absorptive element 146 allows unrestricted airflow communication between the control valve 118 and the manifold 126 while attenuating mechanical vibrations.

The above described arrangement results in a dynamic relationship, conducive to precision force and motion control, between desired airflow (which is proportional to the position of a moveable element within said air control device) and differential pressure.

While the specification and the corresponding drawings reference preferred examples, it should be appreciated that various changes may be made and equivalents maybe substituted for elements thereof without departing from the scope of the present invention as set forth in the following appended claims. In addition, many modifications may be made to adapt a particular situation or material to the teachings of the invention, as set forth in the appended claims, as defined in the appended claims, without departing from the essential scope thereof. Therefore, it is intended that the present invention not be limited to the particular examples illustrated by the drawings and described in the specification as the best modes presently contemplated for carrying out the present invention, but that the present invention will include any embodiments falling within the description of the appended claims and equivalents thereof.

The invention claimed is:

1. A pneumatic cylinder comprising:

a manifold;

a sleeve nested within the manifold, the sleeve and the manifold defining a first channel between the sleeve and the manifold, the sleeve and the manifold defining a second channel, the second channel being different than the first channel; and a piston disposed in the sleeve to separate an interior volume defined by the sleeve into a first working volume and a second working volume, wherein the piston and the sleeve are arranged to enable a difference in air pressure between the first working volume and the second working volume to produce a differential pressure on the piston.

2. The pneumatic cylinder of claim 1, wherein the manifold defines a first aperture associated with the first channel and a second aperture associated with the second channel.

3. The pneumatic cylinder of claim 2, further comprising an air control device operatively coupled to the manifold, the air control device causing air to pass into the manifold via the first aperture and allowing air to pass out of the manifold via the second aperture.

4. The pneumatic cylinder of claim 3, wherein the air control device further causes air to pass into the manifold via the second aperture and allows air to pass out of the manifold via the first aperture.

5. The pneumatic cylinder of claim 3, further comprising a shock mount disposed between the air control device and the manifold.

6. The pneumatic cylinder of claim 2, wherein the manifold includes a body, a first closed end, and a second closed end.

7. The pneumatic cylinder of claim 6, wherein the first aperture is defined in the body at a first distance from the first closed end and a second distance from the second closed end, wherein the first distance is substantially equal to the second distance.

8. The pneumatic cylinder of claim 1, further comprising a rod operatively coupled to the piston, wherein the differential pressure on the piston causes a mechanical motion of the rod.

9. The pneumatic cylinder of claim 1, wherein the first channel is substantially equal in length to the second channel.

10. A pneumatic cylinder comprising:

a manifold;

a sleeve nested within the manifold, the sleeve and the manifold defining a first channel between the sleeve and the manifold, the first channel including a noise absorbing material, the first channel having a first cross-sectional area, the sleeve having a second cross-sectional area, wherein the first cross-sectional area is substantially equal to the second cross-sectional area; and a piston disposed in the sleeve to separate an interior volume defined by the sleeve into a first working volume and a second working volume, wherein the piston and the sleeve are arranged to enable a difference in air pressure between the first working volume and the second working volume to produce a differential pressure on the piston.

11. The pneumatic cylinder of claim 10, wherein the sleeve and the manifold define a second channel, the second channel being different than the first channel.

12. The pneumatic cylinder of claim 11, wherein the manifold defines a first aperture associated with the first channel and a second aperture associated with the second channel.

13. The pneumatic cylinder of claim 12, further comprising an air control device operatively coupled to the manifold, the air control device causing air to pass into the manifold via the first aperture and allowing air to pass out of the manifold via the second aperture.

14. The pneumatic cylinder of claim 13, wherein the air control device further causes air to pass into the manifold via the second aperture and allows air to pass out of the manifold via the first aperture.

15. The pneumatic cylinder of claim 13, further comprising a shock mount disposed between the air control device and the manifold.

16. The pneumatic cylinder of claim 12, wherein the manifold includes a body, a first closed end, and a second closed end.

17. The pneumatic cylinder of claim 16, wherein the first aperture is defined in the body at a first distance from the first closed end and a second distance from the second closed end, wherein the first distance is substantially equal to the second distance.

18. The pneumatic cylinder of claim 10, wherein the piston comprises a plurality of concentric discs.

19. A pneumatic cylinder comprising:

a body;

a wall within the body, the wall defining a first airflow channel, a second airflow channel, and a working volume, wherein the first airflow channel is substantially equal in length to the second airflow channel, the first airflow channel including a noise absorbing material; and a piston disposed in the working volume to separate the working volume into a first working volume and a second working volume, wherein the piston is arranged to enable a difference in air pressure between the first working volume and the second working volume to produce a differential pressure on the piston.

20. The pneumatic cylinder of claim 19, wherein the noise absorbing material further comprises a first silencer to diffuse a sound wave.

21. The pneumatic cylinder of claim 20, wherein the first silencer comprises a porous bronze element.

22. The pneumatic cylinder of claim 19, wherein an aperture is defined in the body at a first distance from a first closed end and a second distance from a second closed end, wherein the first distance is substantially equal to the second distance.

23. The pneumatic cylinder of claim 19, wherein the body is an extruded body.

24. A pneumatic cylinder comprising:

a manifold;

a sleeve nested within the manifold, the sleeve and the manifold defining a first channel between the sleeve and the manifold, the sleeve and the manifold defining a second channel, the second channel being different than the first channel;

a piston disposed in the sleeve to separate an interior volume defined by the sleeve into a first working volume and a second working volume, wherein the piston and the sleeve are arranged to enable a difference in air pressure between the first working volume and the second working volume to produce a differential pressure on the piston; and a first silencer disposed between the first channel and the first working volume, the first silencer to diffuse a first sound wave associated with air moving between the first channel and the first working volume.

25. The pneumatic cylinder of claim 24, further comprising a first end cap partially enclosing a first end of the sleeve and a second end cap partially enclosing a second end of the sleeve.

26. The pneumatic cylinder of claim 25, wherein the first silencer is integrated into the first end cap.

27. The pneumatic cylinder of claim 26, wherein a second silencer is integrated into the second end cap.

28. The pneumatic cylinder of claim 27, wherein the first silencer comprises a first porous bronze element and the second silencer comprises a second porous bronze element.

29. The pneumatic cylinder of claim 24, wherein the first silencer comprises a porous bronze element.

30. The pneumatic cylinder of claim 24, further comprising a second silencer disposed between with the second channel and the second working volume, the second silencer to diffuse a second sound wave associated with air moving between the second channel and the second working volume.

31. A pneumatic cylinder comprising:

a manifold;

a sleeve nested within the manifold, the sleeve and the manifold defining a first channel between the sleeve and the manifold, the sleeve and the manifold defining a second channel, the second channel being different than the first channel;

a piston disposed in the sleeve to separate an interior volume defined by the sleeve into a first working volume and a second working volume, wherein the piston and the sleeve are arranged to enable a difference in air pressure between the first working volume and the second working volume to produce a differential pressure on the piston; and wherein the first channel is lined with a noise absorbing material.

32. A pneumatic cylinder comprising:

a manifold;

a sleeve nested within the manifold, the sleeve and the manifold defining a first channel between the sleeve and the manifold, the first channel having a first cross-sectional area, the sleeve having a second cross-sectional area, wherein the first cross-sectional area is substantially equal to the second cross-sectional area;

a piston disposed in the sleeve to separate an interior volume defined by the sleeve into a first working volume and a second working volume, wherein the piston and the sleeve are arranged to enable a difference in air pressure between the first working volume and the second working volume to produce a differential pressure on the piston; and a silencer disposed between the first channel and the first working volume, the silencer to diffuse a sound wave associated with air moving between the first channel and the first working volume.

33. The pneumatic cylinder of claim 32, wherein the silencer comprises a porous bronze element.

34. A pneumatic cylinder comprising:

a manifold;

a sleeve nested within the manifold, the sleeve and the manifold defining a first channel between the sleeve and the manifold, the first channel having a first cross-sectional area, the sleeve having a second cross-sectional area, wherein the first cross-sectional area is substantially equal to the second cross-sectional area;

a piston disposed in the sleeve to separate an interior volume defined by the sleeve into a first working volume and a second working volume, wherein the piston and the sleeve are arranged to enable a difference in air pressure between the first working volume and the second working volume to produce a differential pressure on the piston; and wherein the first channel is lined with a noise absorbing material.

35. A pneumatic cylinder comprising:

a body;

a wall within the body, the wall defining a first airflow channel, a second airflow channel, and a working volume, wherein the first airflow channel is substantially equal in length to the second airflow channel; and a piston disposed in the working volume to separate the working volume into a first working volume and a second working volume, wherein the piston is arranged to enable a difference in air pressure between the first working volume and the second working volume to produce a differential pressure on the piston; and a first silencer to diffuse a sound wave, wherein the first silencer is disposed between the first airflow channel and the first working volume, the first silencer to diffuse a first sound wave associated with air moving between the first airflow channel and the first working volume.

36. The pneumatic cylinder of claim 35, further comprising a second silencer disposed between with the second airflow channel and the second working volume, the second silencer to diffuse a second sound wave associated with air moving between the second airflow channel and the second working volume.

37. A pneumatic cylinder comprising:

a body;

a wall within the body, the wall defining a first airflow channel, a second airflow channel, and a working volume, wherein the first airflow channel is substantially equal in length to the second airflow channel; and a piston disposed in the working volume to separate the working volume into a first working volume and a second working volume, wherein the piston is arranged to enable a difference in air pressure between the first working volume and the second working volume to produce a differential pressure on the piston; and a first silencer to diffuse a sound wave, wherein the first silencer is integrated into a first end cap.

38. A pneumatic cylinder comprising:

a body;

a wall within the body, the wall defining a first airflow channel, a second airflow channel, and a working volume, wherein the first airflow channel is substantially equal in length to the second airflow channel; and a piston disposed in the working volume to separate the working volume into a first working volume and a second working volume, wherein the piston is arranged to enable a difference in air pressure between the first working volume and the second working volume to produce a differential pressure on the piston; and wherein the first airflow channel is lined with a noise absorbing material.

* * * * *